US006231369B1

(12) United States Patent
Miyajima et al.

(10) Patent No.: US 6,231,369 B1
(45) Date of Patent: May 15, 2001

(54) BOLTED TYPE CONNECTOR

(75) Inventors: Kazuo Miyajima; Takayuki Nishimura, both of Shiga (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/355,927

(22) PCT Filed: Dec. 4, 1998

(86) PCT No.: PCT/JP98/05487

§ 371 Date: Aug. 11, 1999

§ 102(e) Date: Aug. 11, 1999

(87) PCT Pub. No.: WO99/30387

PCT Pub. Date: Jun. 17, 1999

(30) Foreign Application Priority Data

Dec. 11, 1997 (JP) ..... 9-341113
Dec. 12, 1997 (JP) ..... 9-342509

(51) Int. Cl.[7] ..... H01R 13/62
(52) U.S. Cl. ..... 439/364
(58) Field of Search ..... 439/364, 362; 411/369

(56) References Cited

U.S. PATENT DOCUMENTS 5,201,625 * 4/1993 Takenouchi ..... 411/369
5,393,242 * 2/1995 VanderStuyf ..... 439/364

FOREIGN PATENT DOCUMENTS

| | | |
|---|---|---|
| 63-13283 | 1/1988 | (JP) . |
| 1-135655 | 9/1989 | (JP) . |
| 2-34077 | 3/1990 | (JP) . |
| 2-62674 | 5/1990 | (JP) . |
| 4-132215 | 12/1992 | (JP) . |
| 5-34678 | 5/1993 | (JP) . |
| 7-263079 | 10/1995 | (JP) . |
| 8-64264 | 3/1996 | (JP) . |
| 8-288006 | 11/1996 | (JP) . |

* cited by examiner

*Primary Examiner*—Gary F. Paumen
*Assistant Examiner*—Phuong Chi Nguyen
(74) *Attorney, Agent, or Firm*—Arent Fox Kintner Plotkin & Kahn

(57) ABSTRACT

A bolt-tightened connector has a first half connector body and a second half connector body that fit together. A bolt is rotatably attached to the first half connector body. A nut is secured to the second half connector body. An approximately V-shaped single piece plate spring is attached at an intermediate region of the bolt inside the first half connector body. When the connector bodies are fit together, a screw portion of the bolt passes through the nut and the bolt freely turns. Also, the plate spring is compressed and a base end of the screw portion of the bolt is pulled toward the nut by the repulsion force. A harness fixing piece for restricting and securing the drawing direction of the wire harness may also be provided at the first half connector body and be secured to the harness fixing piece by taping.

13 Claims, 9 Drawing Sheets

BOLTED TYPE CONNECTOR

TECHNICAL FIELD

The present invention relates to a bolt-tightened connector used for connecting a wire harness etc. of a vehicle such as an automobile, more specifically relates to a bolt-tightened connector of a type connecting two half connector bodies into one using a nut and bolt.

BACKGROUND ART

A multi-way connector of the related art formed by fitting two half connector bodies requires a large force for connecting the two halves, so, as described in the Japanese Examined Patent Publication (Kokoku) No. 1-57471, one structured by connection by using the tightening force obtained by a nut and bolt has been proposed. Such a bolt-tightened connector is composed of a first half connector body and a second half connector body fitting into each other. A bolt having a screw portion at its front end is rotatably attached to the first half connector body, and a spring member, that is, a coil spring, is interposed between the head of the bolt and the outer wall surface of the first half connector body. On the other hand, a nut is secured to the second half connector body.

According to this configuration, both of the half connector bodies can be connected with a small force by screwing the screw portion of the bolt into the nut. When the two half connector bodies are sufficiently fit together, the screw portion of the bolt passes through the nut and the bolt can be turned freely. Accordingly, a worker can determine that the engagement is completed and thereby prevent damage to the connector due to excessive tightening.

Also, when the screw portion of the bolt passes through the nut, the spring member is compressed and the repulsion force thereof presses the base end of the screw portion of the bolt against the nut. When the bolt is rotated in reverse in this state, the screw portion of the bolt is reliably screwed into the nut, which is convenient at the time of detaching the two half connector bodies.

In the above bolt-tightened connector, however, since a coil spring is interposed as a spring member between the head of the bolt and the outer wall surface of the first half connector body, the length of the bolt projecting from the outer wall surface of the first half connector body becomes longer. Therefore, there is the disadvantage that the first half connector body becomes larger. It has been also proposed to use a spring washer instead of the above coil spring, however, a spring washer has a small contact area with the head of the bolt and the outer wall surface of the first half connector body, so the axis of the bolt easily becomes off-centered and screwing the screw portion of the bolt into the nut is difficult.

Also, in the above bolt-tightened connector, the second half connector body may be formed as a part of an electrical connection box and a wire harness connected to the first half connector body. In such a case, a harness cover is detachably attached to the first half connector body, and the wire harness is drawn out to the outside from a harness outlet formed at a predetermined position of the harness cover.

The wire harness connected to the first connector has a large number of wires due to being for multi-way use and the outer diameter of the plurality of wires bundled together becomes large as well. Therefore, it is difficult to keep the drawing direction of the wire harness from the first connector substantially constant. When forcibly bending the wire harness near the harness outlet to try to adjust the drawing direction of the wire harness, the terminals and wires in the first half connector body are subject to stress which is liable to cause inconvenience.

DISCLOSURE OF INVENTION

A first object of the present invention is to provide a bolt-tightened connector wherein a first half connector body to which the bolt is attached is made compact and the bolt is kept from becoming off-centered axially.

A second object of the present invention is to provide a bolt-tightened connector enabling the direction of drawing the wire harness from the first half connector body to be kept substantially constant and preventing stress from being applied to the terminals or wires in the first half connector body.

A bolt-tightened connector according to the first aspect of the present invention for achieving the first object comprises a first half connector body, a second half connector body to be fitted in the first half connector body, a bolt rotatably held by the first half connector body, a nut secured to the second half connector body, and an approximately V-shaped plate spring which is arranged at an intermediate region of the bolt positioned in the first half connector body, which is compressed when fitting the first half connector body in the second half connector body and a screw portion of the bolt passes through the nut and the bolt freely turns, and which pulls a base end of the screw portion of the bolt to the nut by the repulsion force due to the compression.

By doing this, the portion of the bolt projecting from the outer wall surface of the first half connector body becomes substantially only the head of the bolt, so the first half connector body can be made compact. Further, the approximately V-shaped plate spring gives a large contact area with the members compressing the same, so the possibility of the bolt becoming off-centered axially becomes low.

In the above configuration, the second half connector body may have a cylindrical nut holder for securing the nut, the bolt may have a stopper attached in the intermediate region toward the head and a step portion formed in the intermediate region toward the screw portion, and the plate spring may be attached between the stopper and the step portion and be compressed between the stopper and the front end of the nut holder when the screw portion of the bolt passes through the nut.

By doing this, the possibility of the bolt becoming off-centered axially becomes further smaller and it is possible to prevent the bolt from dropping out from the first half connector body before fitting together the first half connector body and the second half connector body or when separating the first half connector body and the second half connector body and therefore the work efficiency can be vastly improved.

Further, in the above configuration, the nut may be integrally secured to the second half connector body by insert molding or may be inserted into the cylindrical nut holder formed at the second half connector body and then be secured by inserting the cylindrical member to the nut holder to grip it.

By doing this, it is possible to prevent the bolt from dropping out from the second half connector body before fitting together the first half connector body and the second half connector body or when separating the first half connector body and the second half connector body and therefore the work efficiency can be vastly improved. Further, when holding the nut by using the cylindrical member, any bits of metal produced can be kept in the inside space of the cylindrical member and therefore prevented from dispersing elsewhere.

Further, in the above configuration, the plate spring may be held with respect to the first half connector body so as to restrict rotation thereof about the bolt.

By doing this, rattling of the plate spring can be prevented and the screw portion of the bolt can be more reliably guided to the nut when fitting the parts together.

A bolt-tightened connector according to a second aspect of the present invention for achieving the above second object comprises a first half connector body, a second half connector body to be fitted in the first half connector body, a bolt rotatably held by one of the first half connector body and second half connector body; a nut held by the other of the first half connector body and second half connector body, and a harness fixing piece provided at the first half connector body and restricting the drawing direction of the wire harness.

By doing this, the wire harness can be secured in the state drawn out along the harness fixing piece. Accordingly, it is easy to keep the drawing direction of the wire harness substantially constant. As a result, it is possible to prevent stress caused by bending the wire harness etc. from being applied to the internal terminals and wires.

In the above configuration, a slide groove may be provided in the first half connector body to engage with and secure the harness fixing piece and the harness fixing piece may be made attachable and detachable to and from the slide groove.

By doing this, molding of the first half connector body becomes easy and a variety of shapes of harness fixing pieces can be attached in accordance with need.

Also, in the above configuration, a harness cover attached to the first half connector body and covering the wire harness may be provided and a harness outlet for drawing out the wire harness may be provided near the harness fixing piece of the harness cover.

By doing this, it is possible to cover the terminal side portion etc. of the wire harness secured by the harness fixing piece and possible to prevent contact etc. with the outside.

Furthermore, in the above configuration, an approximately V-shaped plate spring may be provided which is arranged at an intermediate region of the bolt positioned inside of one of the first half connector body and the second half connector body, which is compressed when fitting together the first half connector body and the second half connector body and the screw portion of the bolt passes through the nut and freely turns, and which pulls a base end of the screw portion of the bolt toward the nut by the repulsion force caused by the compression.

By doing this, the portion of the bolt projecting from the outer wall surface of one of the first half connector body and the second half connector body becomes substantially only the head of the bolt, so that one of the half connector bodies can be made compact. Further, since the approximately V-shaped plate spring can give a large contact area with the members compressing the same, the possibility of the bolt becoming off-centered axially becomes low.

In the above configuration, the other of the first half connector body and the other second half connector body may have a cylindrical nut holder for securing the nut, the bolt may have a stopper attached in the intermediate region toward the head and a step portion formed in the intermediate region toward the screw portion, and the plate spring may be attached between the stopper and the step portion and be compressed between the stopper and the front end of the nut holder when the screw portion of the bolt passes through the nut.

By doing this, the possibility of the bolt becoming off-centered axially becomes further smaller and it is possible to prevent the bolt from dropping out from the one half connector body before fitting together the first half connector body and the second half connector body or when separating the first half connector body and the second half connector body and therefore the work efficiency can be vastly improved.

Further, in the above configuration, the nut may be integrally secured to the other of the first half connector body and second half connector body by insert molding or may be inserted into the cylindrical nut holder formed at the other half connector body and then be secured by inserting the cylindrical member to the nut holder to grip it. By doing this, it is possible to prevent the nut from dropping out from the other half connector body before fitting together the first half connector body and the second half connector body or when separating the first half connector body and the second half connector body and therefore the work efficiency can be vastly improved. Further, when holding the nut by using the cylindrical member, any bits of metal produced can be kept in the inside space of the cylindrical member and therefore prevented from dispersing elsewhere.

Further, in the above configuration, the plate spring may be held with respect to one of the first half connector body and second half connector body so as to restrict rotation thereof about the bolt.

By doing this, rattling of the plate spring can be prevented and the screw portion of the bolt can be more reliably guided to the nut when fitting the parts together.

BRIEF DESCRIPTION OF DRAWINGS

FIGS. 1A to 1C show one embodiment of a bolt-tightened connector according to a first aspect of the present invention, wherein FIG. 1A is a sectional view of the state at the time of start of the fitting, FIG. 1B is a sectional view of the state during the fitting, and FIG. 1C is a sectional view of the state after the fitting;

FIGS. 3A to 3C show a plate spring used in the embodiment of FIG. 1, wherein FIG. 3A is a plan view, FIG. 3B is a front view, and FIG. 3C is a bottom view;

FIGS. 8A and 8B show a bolt-tightened connector in still another embodiment of the present invention, wherein FIG. 8A is a view of the state at the time of start of fitting and FIG. 8B is a view of the state after fitting;

FIGS. 9A to 9C show an embodiment of a bolt-tightened connector according to a second aspect of the present invention, wherein FIG. 9A is a plan view of the first half connector body, FIG. 9B is a front view of the first half connector body, and FIG. 9C is a bottom view of the first half connector body;

FIGS. 10A and 10B show a bolt-tightened connector of FIGS. 9A to 9C, wherein FIG. 10A is a view from the left side of the first half connector body and FIG. 10B is a view from the right side of the first half connector body;

FIGS. 12A and 12B show the second half connector body fit in the first half connector body of FIGS. 9A to 9C, wherein FIG. 12A is a plan view and FIG. 12B is a front view.

BEST MODE FOR CARRYING OUT THE INVENTION

Below, embodiments of the present invention will be explained in detail with reference to the accompanying drawings.

FIG. 1 shows an embodiment of a bolt-tightened connector according to a first aspect of the present invention. This bolt-tightened connector comprises, as shown in FIG. 1, a first half connector body 1 and a second half connector body 2. The first half connector body 1 and the second half connector body 2 are formed to fit with each other. Also, the first half connector body 1 and the second half connector body 2 are provided with a plurality of terminals (not shown) for electrical connection.

Figure 2:
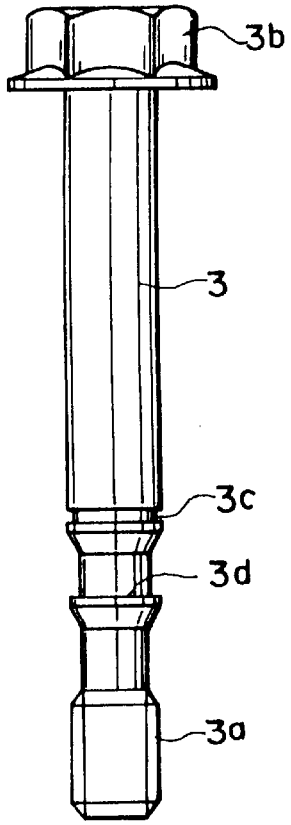
FIG. 2 is a front view of the bolt used in the embodiment of FIGS. 1A to 1C.

The first half connector body 1 has a cylinder portion 6 vertically projecting at the center portion of a housing. A bolt 3 is passed rotatably through the cylinder portion 6. The bolt 3 has, as shown in FIG. 2, a head 3*b* at one end and a screw portion 3*a* at the other end and has a groove 3*c* for mounting a stopper at an intermediate portion toward the head 3*b* and a step portion 3*d* with a step surface facing the head 3*b* side at the intermediate portion toward the screw portion 3*a*. The outer diameter of the step portion 3*d* is the same as or a little smaller than the outer diameter of the screw portion 3*a*.

A plate-shaped stopper 7 is attached at the groove 3*c* of the bolt 3 as shown in FIG. 1. As the stopper 7, a C-ring etc. on the market can be used. Also, an approximately V-shaped plate spring 5 is attached between the stopper 7 and the step portion 3*d*.

Figure 3A:
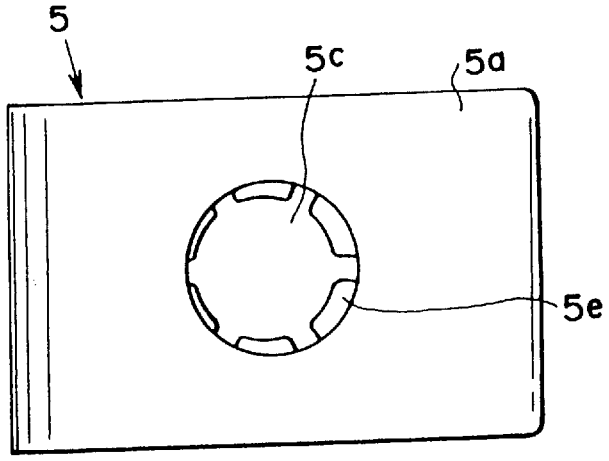
Figure 3B:
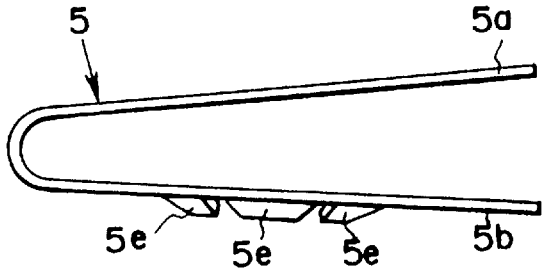
Figure 3C:
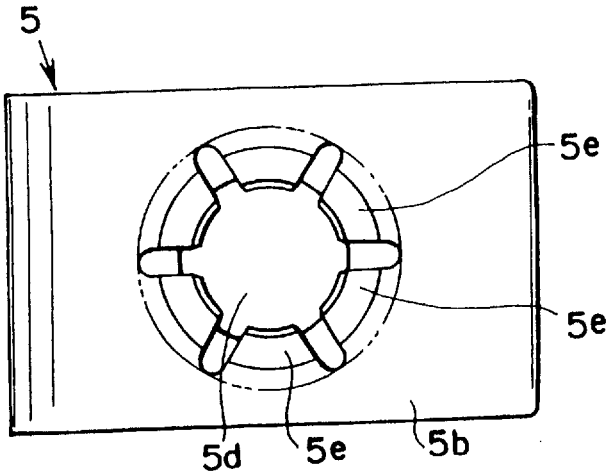

The plate spring 5 has, as shown in FIGS. 3A to 3C, an upper bolt through hole 5*c* and a lower bolt through hole 5*d* respectively formed on an upper plate portion 5*a* and a lower plate portion 5*b* and has a plurality of tooth portions 5*e* formed facing downward at a slant at the edge of the lower bolt through hole 5*d*.

The inner diameter of a circular hole formed by the front ends of the plurality of the tooth portions 5*e* is set smaller than the outer diameter of the step portion 3*d* of the bolt 3. As a result, when the plate spring 5 passes to the bolt 3 from the screw portion 3*a* side, the upper plate portion 5*a* of the plate spring 5 hits the stopper 7 first. When further pressing up the lower plate portion 5*b*, the tooth portions 5*e* elastically deform, ride over the outer circumference of the step portion 3*d*, then catch on the step portion 3*d*. In this state, the plate spring 5 can no longer pull out from the bolt 3. Also, the plate spring 5 opens in interval between the upper plate portion 5*a* and the lower plate portion 5*b* the further to the free end and has an extra margin to be compressed. Further, the plate spring 5 is held in the first half connector body 1 so that it cannot rotate. Due to this, the rattling of the plate spring 5 can be prevented.

On the other hand, the second half connector body 2 has a nut 4 attached to it so as not to rotate. In this embodiment, the nut 4 is integrally secured in the cylindrical nut holder 8 formed in the second half connector body 2 by insert molding.

Figure 1A:
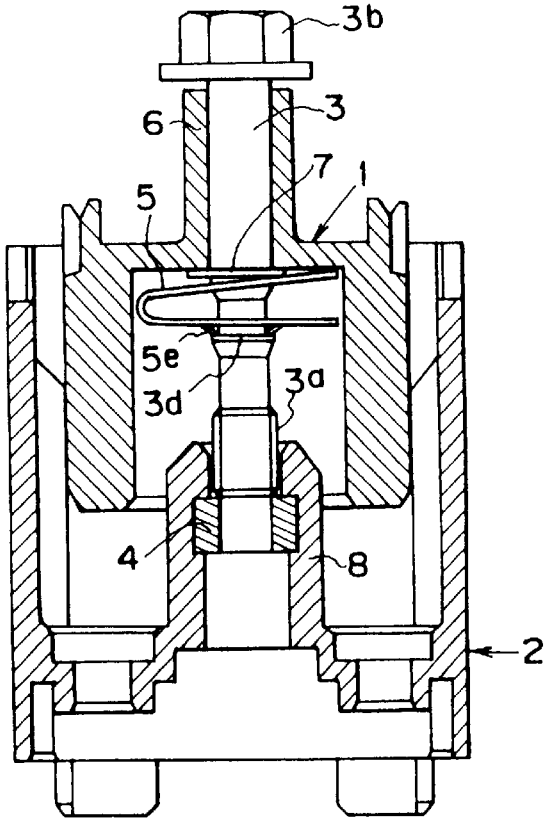
Figure 1B:
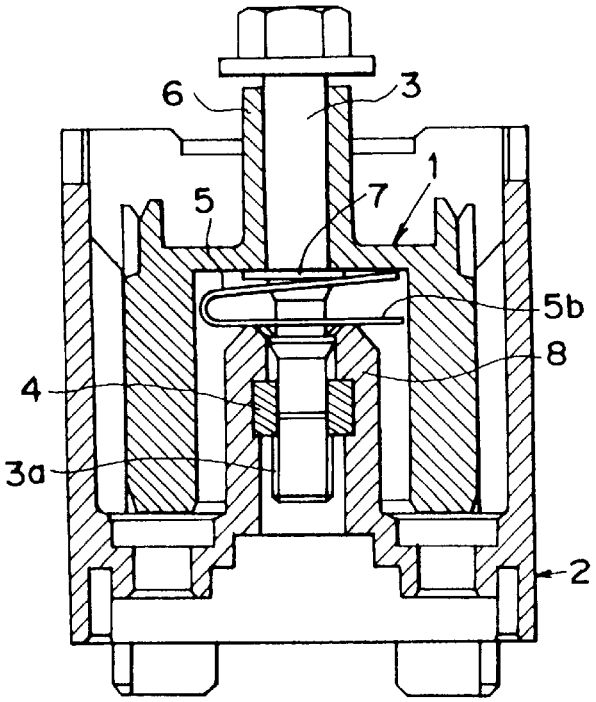

In the bolt-tightened connector having the above configuration, when the first half connector body 1 is fit into the second half connector body 2, first, as shown in FIG. 1A, the front end of the screw portion 3*a* of the bolt 3 strikes the nut 4. Then, by rotating the bolt 3 in the clockwise direction and screwing the screw portion 3*a* into the nut 4, the two connector half bodies 1 and 2 are fit together. FIG. 1B shows the stage where the two half connector bodies 1 and 2 are being fit together and the lower plate portion 5*b* of the plate spring 5 contacts the front end of the nut holder 8. At this stage, the two half connector bodies 1, 2 substantially finish being fit together, but the plate spring 5 is not yet compressed from the initial state. Further, the screw portion 3*a* of the bolt is still engaged with the nut 4.

Figure 1C:
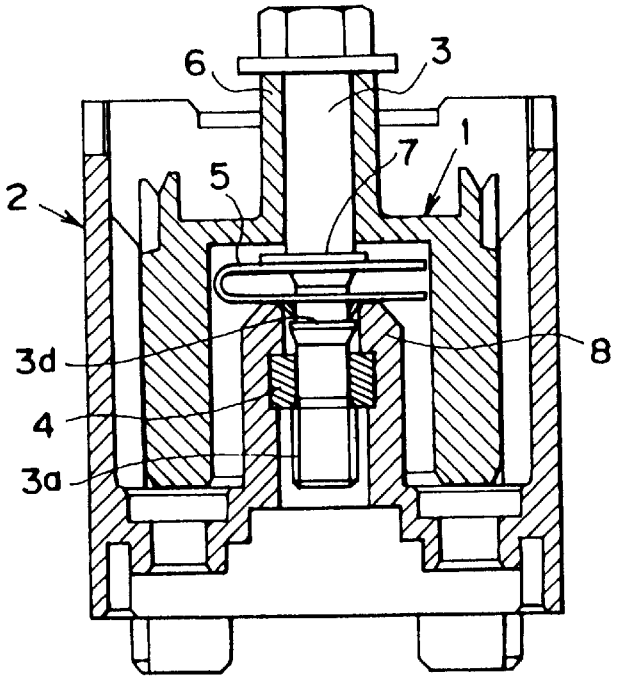

When further screwing in the bolt 3, finally, as shown in FIG. 1C, the screw portion 3*a* of the bolt passes through the nut 4 and the bolt 3 turns freely. As a result, a worker can determine that the two half connector bodies 1 and 2 have been completely fit together. Also, in this state, the plate spring 5 is compressed between the stopper 7 and the front end of the nut holder 8 and generates a repulsion force. The base end of the screw portion 3*a* of the bolt is pulled toward the nut 4 by this repulsion force. Therefore, when separating the two half connector bodies 1 and 2, the separating work can be performed easily by just turning the bolt 3 in the counterclockwise direction, so the screw portion 3*a* of the bolt 3 is reliably screwed in the nut 4.

Figure 4:
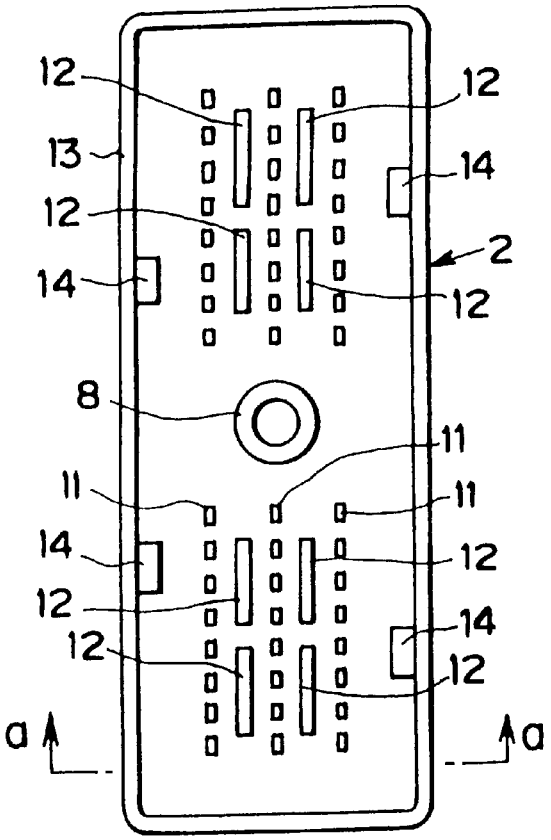
FIG. 4 is a plan view of a second half connector in another embodiment of the present invention.
Figure 5:
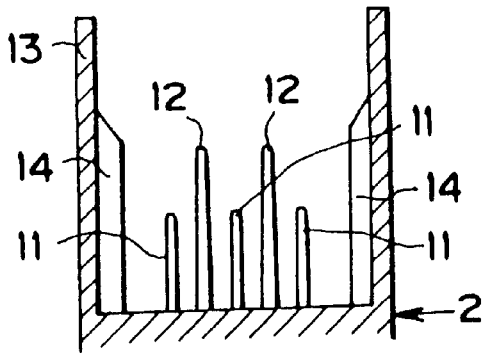
FIG. 5 is a sectional view along the line a—a of FIG. 4.

FIGS. 4 and 5 show another embodiment of the present invention. Inside the second connector half body 2, a plurality of male terminals 11 are arranged in the state projected from the bottom surface. Accordingly, when carelessly fitting the first connector half body 1, part of the housing etc. of the first connector half body 1 strikes the front ends of the male terminals 11 and easily cause an inconvenience such as bending of the male terminals 11 etc. To prevent the inconvenience, in the present embodiment, ribs 12 higher than the male terminals 11 are provided projecting between the rows of the male terminals 11 so that when fitting the first half connector body 1, the part of the housing etc. does not directly strike the front ends of the male terminals 11.

Further, the nut holder 8 of the second connector half body 2 is normally formed at the center of a portion surrounded by a peripheral wall 13, and the bolt 3 to be passed through the first connector half body 1 is also provided at the corresponding position. Therefore, the first connector half body 1 is, in some cases, erroneously fit in the second connector half body 2 in the opposite direction or in an inclined state. In this case as well, deformation of the male terminals 11 etc. easily occurs. To prevent this, in the present embodiment, guide projections 14 extending in the fitting direction are formed asymmetrically to the right and left on the inner surface of the peripheral wall 13 and guide grooves (not shown) corresponding to the guide projections 14 are formed on the outer surface of the first half connector body 1 so that the first half connector body 1 cannot be fit in the opposite direction or in an inclined state when fitting the first half connector body 1.

Figure 6:
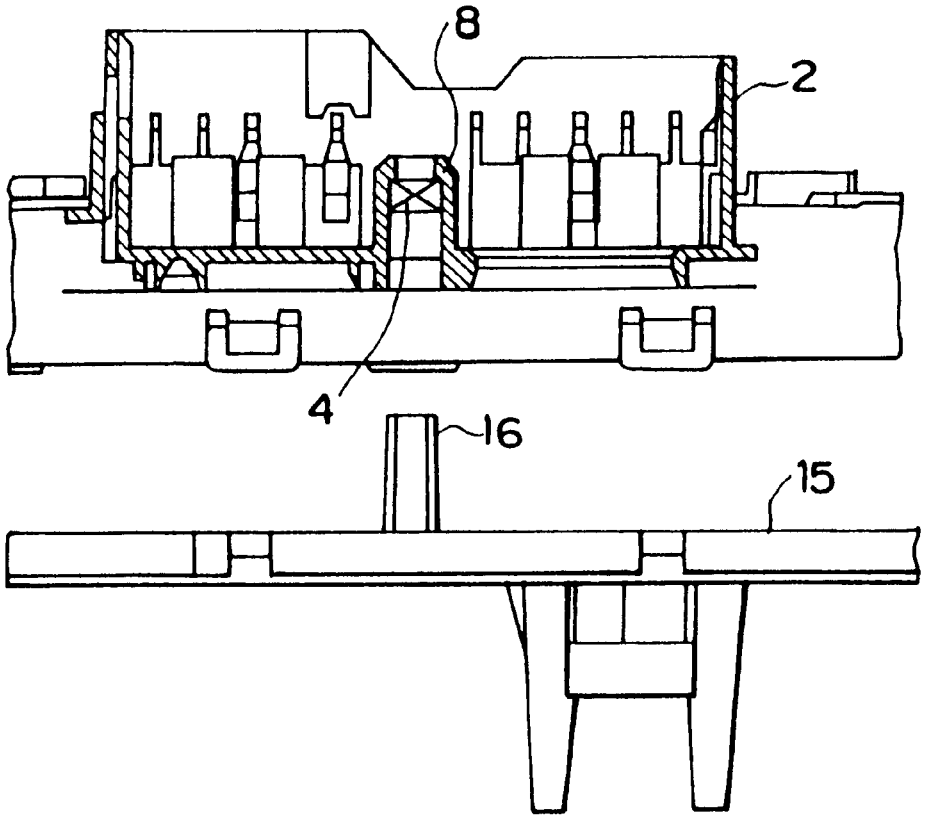
FIG. 6 is a sectional view of a second half connector body in still another embodiment of the present invention.
Figure 7:
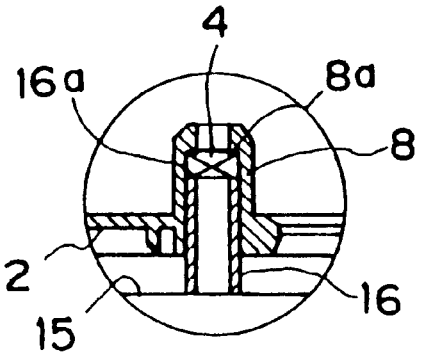
FIG. 7 is a sectional view of an assembled state of the core part of the embodiment shown in FIG. 6.

FIGS. 6 and 7 show still another embodiment of the present invention. In the embodiment of FIG. 1, the nut 4 was formed by insert molding inside the cylindrical nut holder 8 formed in the second half connector body 2, however, the insert molding is troublesome. Therefore, in the present embodiment, the nut 4 is press fit inside the nut holder 8 formed in the second half connector body 2, and a cylindrical member 16 is provided projecting from a case member 15 to be assembled to the further lower side of the second half connector body 2. By inserting the cylindrical member 16 to the nut holder 8, the step portion 8*a* of the nut holder 8 and the front end portion 16*a* of the cylindrical member 16 hold the nut 4 between them. By doing so, the nut 4 can be firmly secured to the second half connector body 2 without the insert molding. Also, when attaching and detaching the two half connector bodies 1 and 2, since bits of metal generated from the screw portion 3*a* and the nut 4 can be kept in the inside space of the cylindrical member 16, the bits of metal can be prevented from spreading inside the electrical connection box.

As explained above, according to the bolt-tightened connector according to the first aspect of the present invention, since the approximately V-shaped plate spring 5 is attached at an intermediate part of the bolt 3 positioned inside the first half connector body 1, the length of the bolt 3 projecting from the outer wall surface of the first half connector body 1 can be made shorter and the first half connector body 1 can be made compact. Further, since the approximately V-shaped plate spring 5 has a larger contact area with the members compressing it, the bolt 3 is less liable to become off-centered axially and the work of fitting together the two half connector bodies 1 and 2 becomes easier.

Figure 8A:
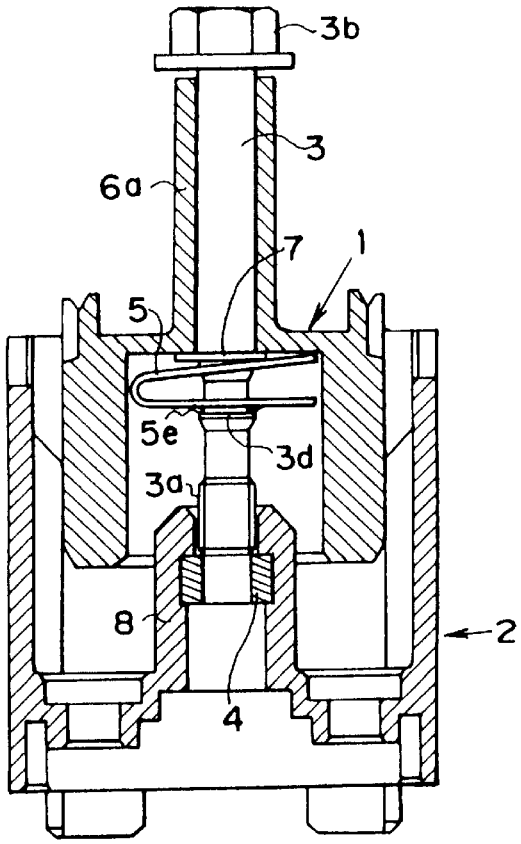
Figure 8B:
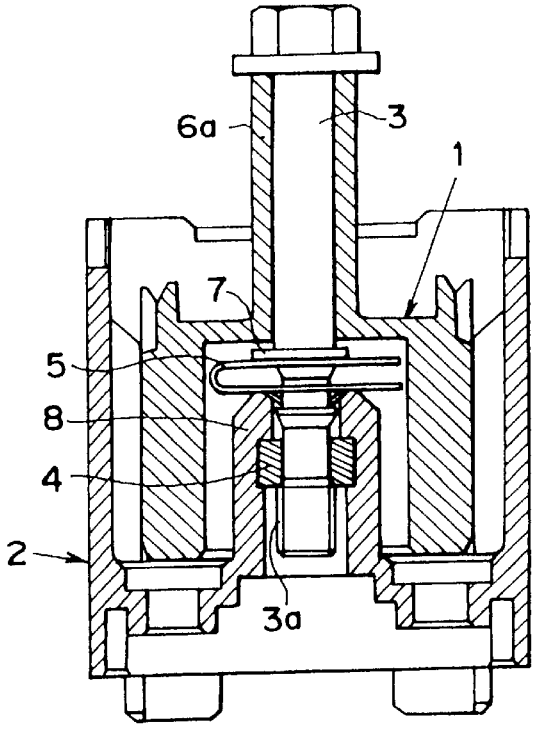

FIGS. 8A and 8B show still another embodiment of the present invention. In the present embodiment, the first half connector body 1 has a cylinder portion 6*a* vertically projecting from the center of the housing, and the cylinder portion 6*a* is formed longer than the cylinder portion 6 shown in FIG. 1. Accordingly, when fitting together the two half connector bodies 1 and 2 in a place the worker cannot see, he or she can perform the work by gripping the cylinder portion 6*a*. Due to this, the work can be facilitated.

FIGS. 9A to 9C to 12A and 12B show an embodiment of the bolt-tightened connector according to the second aspect of the present invention. The bolt-tightened connector comprises, in the same way as the explained bolt-tightened connector shown in FIG. 1, a first half connector body 100 to which a bolt 3, a plate spring 5, and a stopper 7 are attached, a second half connector body 200 to which a nut 4 is attached, and a harness cover 300 to be attached to the first half connector body 100.

Note that the relationship between the bolt 3 attaching the plate spring 5 and the stopper 7 and the first half connector body 100, the relationship between the nut 4 and the second half connector body 200, and the actions of the bolt 3, the nut 4, the plate spring 5, and the stopper 7 at the time of fitting together the first half connector body 100 and the second half connector body 200 are the same as in the above explained case shown in FIG. 1, so the explanations thereof will be omitted here.

The first half connector body 100 is covered by the harness cover 300 as shown in FIGS. 9A to 9C and FIGS. 10A and 10B. The harness cover 300 is detachably attached to the first half connector body 100. At one end side of the harness cover 300, a harness outlet 130 is formed for drawing out the wire harness 120 to the outside.

Corresponding to the harness outlet 130, the one end side of the first half connector body 100 is provided with a harness fixing piece 140 for restricting and securing the drawing direction of the wire harness 120. The wire harness 120 connected to the first half connector body 100 is secured to the harness fixing piece 140 by taping etc.

As a result, the drawing direction of the wire harness 120 from the first half connector body 100 can be made substantially constant. Even if the wire harness 120 is forcibly bent near the outside of the first half connector body 100, effects due to the bending are blocked at the position where the wire harness 120 is secured to the harness fixing piece 140 and do not reach the terminals in the first half connector body 100, so the stress imposed on the terminals and the wires can be made smaller.

Note that the harness cover 300 is assembled to the first half connector body 100 after connecting the wire harness 120 to the first half connector body 100 and further securing the wire harness 120 to the harness fixing piece 140 by taping etc.

Next, the structure of attachment of the harness fixing piece 140 and the structure of preventing erroneous assembly of the two half connector bodies 100 and 200 will be explained.

Figure 10A:
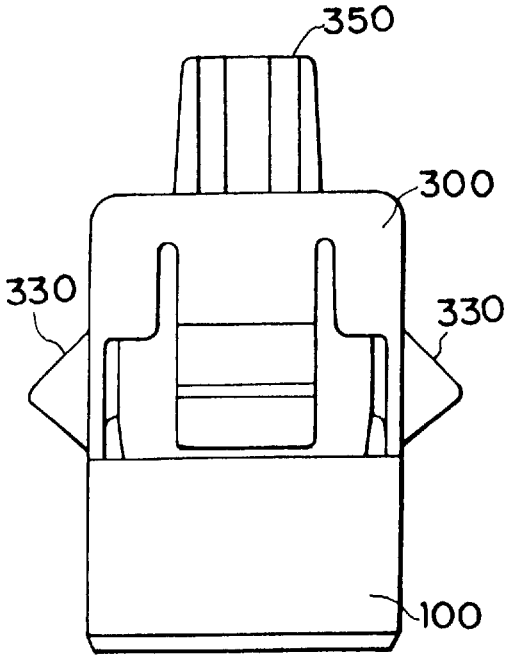
Figure 10B:
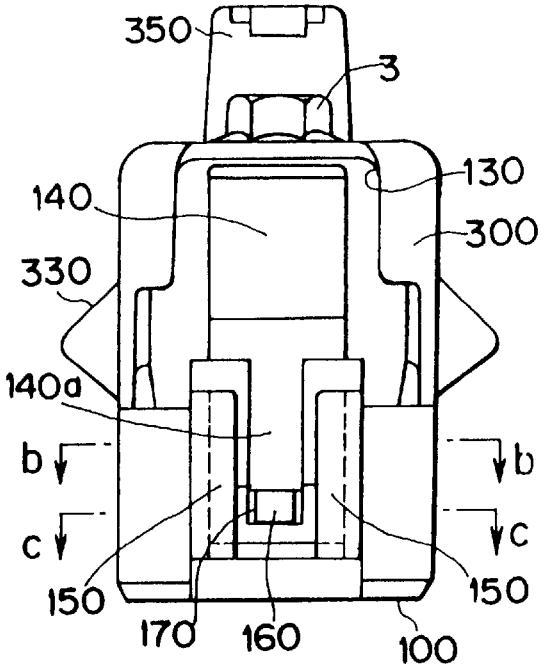
Figure 11A:
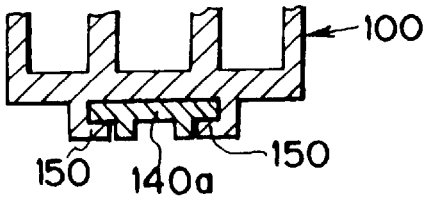
FIG. 11A is a sectional view along the line b—b of FIG. 10B.
Figure 11B:
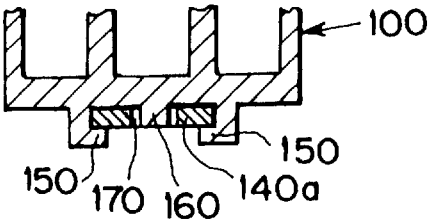
FIG. 11B is a sectional view along the line c—c of FIG. 10B.

The side surface of the one end of the first half connector body 100 is provided with a mount 150 for the harness fixing piece 140 projecting from it. The mount 150, as shown in FIGS. 10B and 11, is fit in by sliding the plate-shaped base portion 140*a* of the harness fixing piece 140 and forms a slide groove for securing the harness fixing piece 140. When projections 160 are formed between the mounts 150 on the two sides, and the base portion 140*a* of the harness fixing piece 140 is inserted to the mount 150 to the end, the projections 160 enter into a window portion 170 formed in the base portion 140*a* of the harness fixing piece 140. As a result, the harness fixing piece 140 becomes impossible to pull out. Note that the side surface of the other end of the first half connector body 100 is flat and there is no projecting portion formed on it corresponding to the mount 150.

Figure 12A:
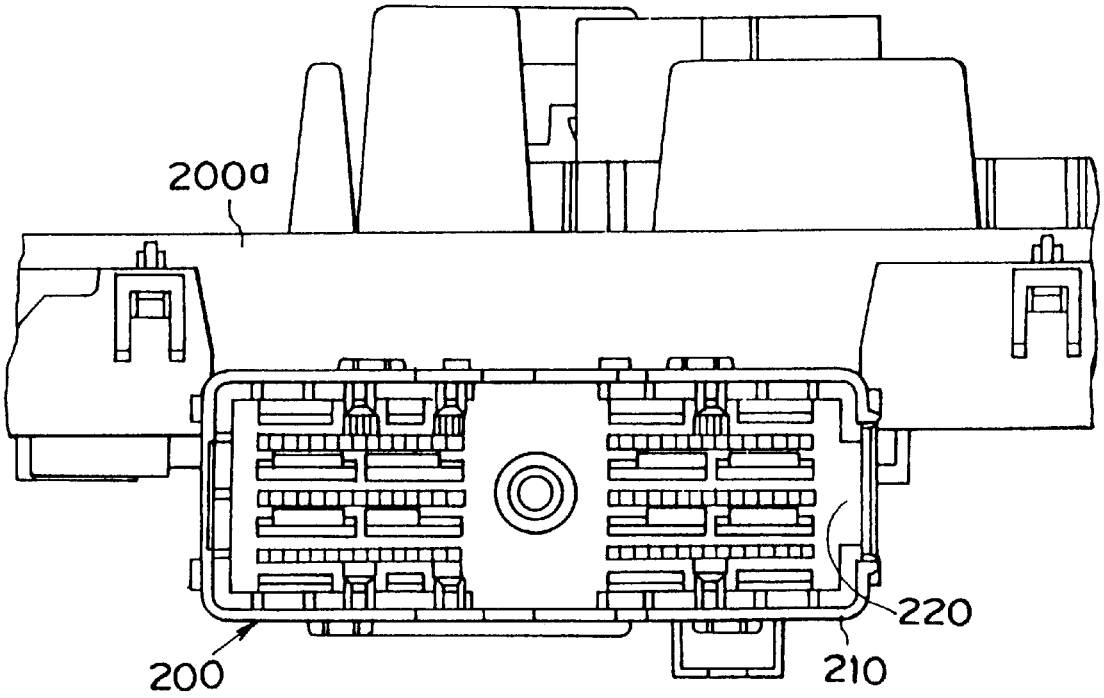

On the other hand, the second half connector body 200, as shown in FIG. 12A, is formed at one end inside the peripheral wall 210 with a recessed portion 220 to which the mount 150 slidingly fits. The other end inside the peripheral wall 210 is not formed with anything corresponding to the recessed portion 220.

When structured in this way, when fitting the first half connector body 100 in the second half connector body 200, fitting is impossible unless the mount 150 of the harness fixing piece 140 is aligned with the recessed portion 220 of the second half connector body 200. Therefore, erroneous assembling, that is, erroneously fitting the first half connector body 100 in the opposite direction to the right and left, can be prevented.

Note that, in the present embodiment, a case was explained where the harness fixing piece 140 was produced as a separate member from the housing of the first half connector body 100 and then attached to the housing of the first half connector body 100, however, the harness fixing piece 140 can also be formed integrally with the housing of the first half connector body 100. Also, as shown in FIG. 12, the second half connector body 200 is formed as a part of the electrical connector box 200*a*. Further, although the configuration where the harness fixing piece 140 was attached to the first half connector body 100 was shown, it may be configured to be attached to the second half connector body 200 as well.

Next, a means for confirming the fit of the first half connector body 100 and the second half connector body 200 will be explained.

Figure 9A:
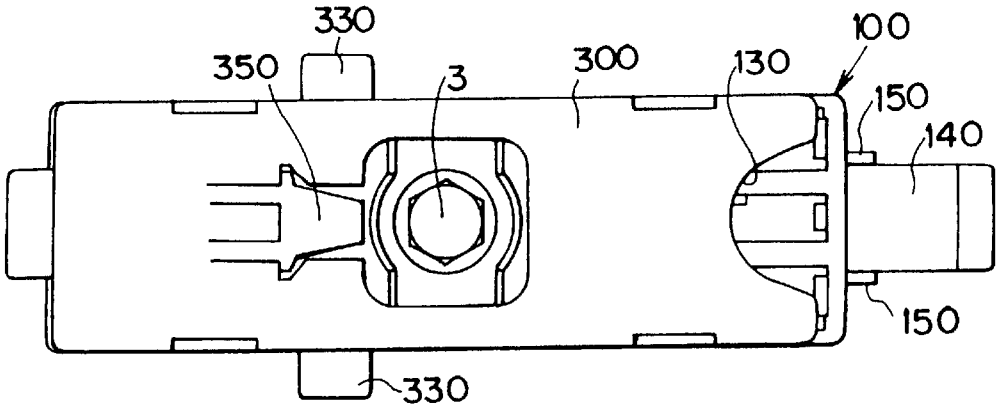
Figure 9B:
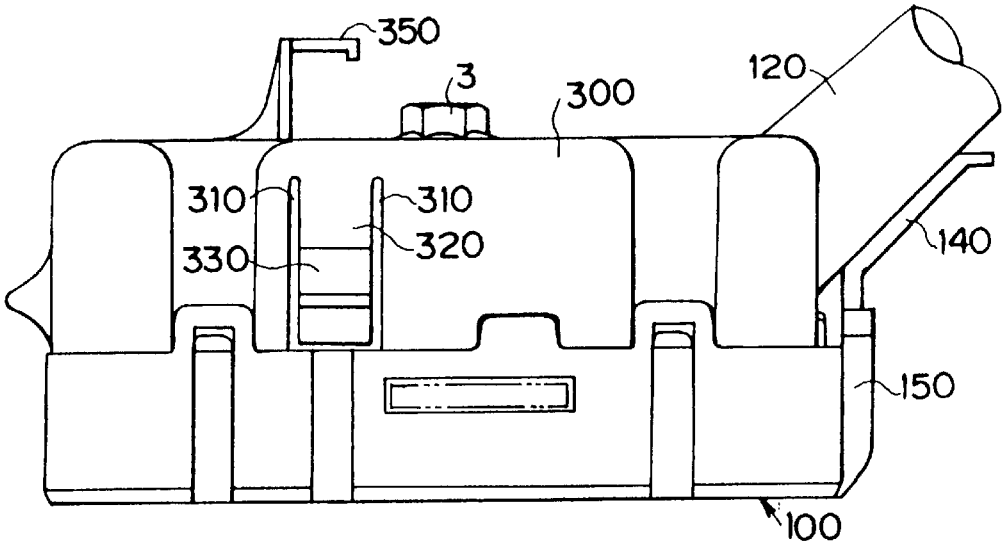
Figure 9C:
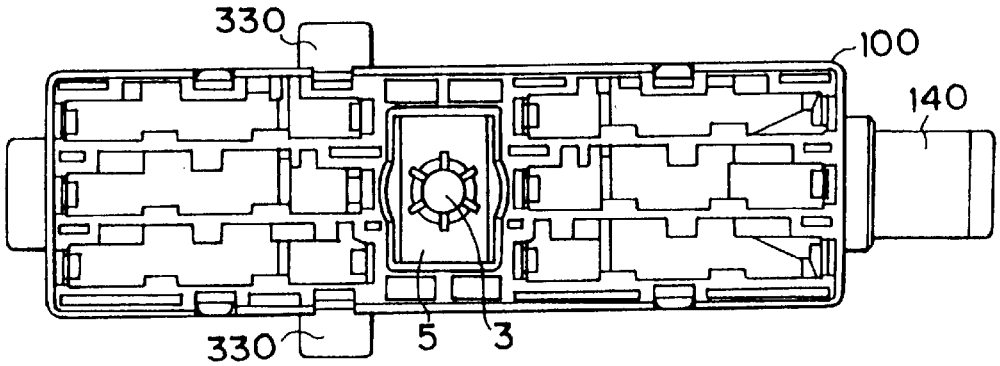

As shown in FIG. 9B, the front surface of the harness cover 300 attached to the first half connector body 100 is formed with an elastic piece 320 by forming two slits 310. The free end of the elastic piece 320 is formed with a triangular peak-shaped projection 330 projecting from the peripheral wall of the harness cover 300.

Figure 12B:
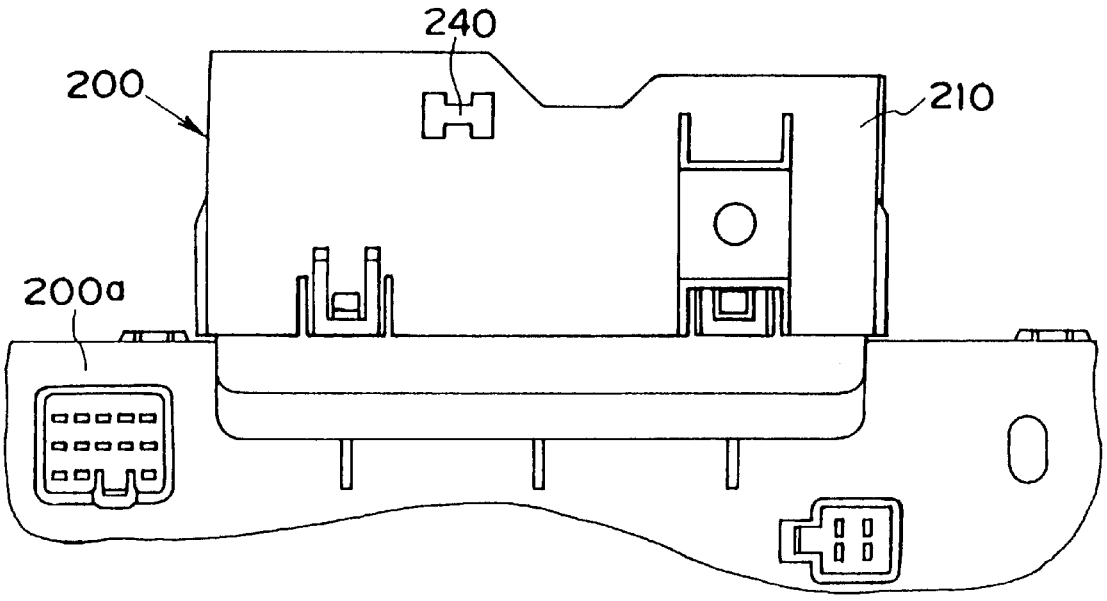

On the other hand, the front surface of the peripheral wall 210 of the second half connector body 200 is formed with a hole 240 as shown in FIG. 12B. This hole 240 has a size enabling the top portion of the projection 330 formed on the elastic piece 320 to enter into it and formed at the position where the projection 330 is inserted when the first half connector body 100 and the second half connector body 200 are completely fit together.

Accordingly, when fitting the first half connector body 100 into the second half connector body 200 by screwing the bolt 3, the fitting proceeds while the elastic piece 320 elastically deforms toward the inside. When the fit is completed, the top portion of the projection 330 is inserted into the hole 240 of the peripheral wall 210 of the second half connector body 200 and the top portion of the projection 330 can be seen from the outside. As a result, even after the fitting work is finished, it is possible to confirm whether the fit was correctly done by the fact that the projection 330 can be seen inside the hole 240.

Note that a hook 350 formed on the upper surface of the harness cover 300 is for temporarily hanging the first half connector body 100 from a part of a vehicle body at the stage of preparation before fitting the first half connector body 100 into the second half connector body 200.

As explained above, according to the bolt-tightened connector of the second aspect of the present invention, by providing the first half connector body 100 with the harness fixing piece 140 for restricting and securing the drawing direction of the wire harness 120, the wire harness 120 can be secured in the state drawing the wire harness 120 along with the harness fixing piece 140. Accordingly, it becomes easy to make the drawing direction of the wire harness 120 substantially constant. Also, due to this, it becomes possible to make it difficult for the stress due to bending etc. of the wire harness 120 to be applied to the terminal and wires inside the first half connector body 100.

INDUSTRIAL APPLICABILITY

As explained above, the bolt-tightened connector of the present invention makes assembly easy while making itself compact and, furthermore, is capable of reducing the stress etc. imposed on the terminals and wires by restricting the drawing direction of the wire harness, so is useful for use as multi-way connector of a vehicle such as an automobile.

What is claimed is:

1. A bolt-tightened connector, comprising:

a first half connector body;

a second half connector body to be fitted in the first half connector body;

a bolt rotatably held by one of the first half connector body and second half connector body;

a nut held by the other of the first half connector body and second half connector body; and a harness fixing piece provided at the first half connector body and restricting the drawing direction of the wire harness wherein provision is made of a harness cover attached to the first half connector body and covering the wire harness and the harness cover has a harness outlet for drawing out the wire harness near the harness fixing piece.

2. A bolt-tightened connector comprising:

a first half connector body, a second half connector body to be fitted in the first half connector body, a bolt rotatably held by the first half connector body and having a head and a screw portion disposed opposite the head, a nut secured to the second half connector body, a stopper carried by the bolt and disposed apart from and between the head and screw portion of the bolt at an intermediate region of the bolt, and an approximately V-shaped single piece plate spring which is arranged at the intermediate region of the bolt positioned in the first half connector body, which is compressed when fitting the first half connector body in the second half connector body and the screw portion of the bolt passes through the nut and the bolt freely turns, and which pulls a base end of the screw portion of the bolt to the nut by a repulsion force due to compression of the approximately V-shaped single piece plate spring compressed between and in contact with the stopper and the second half connector body.

3. A bolt-tightened connector according to claim 2, wherein the second half connector body has a cylindrical nut holder for securing the nut, the bolt has a stopper attached in the intermediate region toward the head and a step portion formed in the intermediate region toward the screw portion, and the plate spring is attached between the stopper and the step portion and is compressed between the stopper and the front end of the nut holder when the screw portion of the bolt passes through the nut.

4. A bolt-tightened connector according to claim 2, wherein the nut is integrally secured to the second half connector body by insert molding.

5. A bolt-tightened connector according to claim 2, wherein the nut is inserted into the cylindrical nut holder formed at the second half connector body and then is secured by inserting the cylindrical member to the nut holder to grip it.

6. A bolt-tightened connector according to claim 2, wherein the plate spring is held with respect to the first half connector body so as to restrict rotation thereof about the bolt.

7. A bolt-tightened connector comprising:

a first half connector body, a second half connector body to be fitted in the first half connector body, a bolt rotatably held by one of the first half connector body and second half connector body and having a head and a screw portion disposed opposite the head, a nut held by the other of the first half connector body and second half connector body, a stopper carried by the bolt and disposed apart from and between the head and screw portion of the bolt at an intermediate region of the bolt, a harness fixing piece provided at the first half connector body and restricting the drawing direction of the wire harness, and an approximately V-shaped single piece plate spring arranged at the intermediate region of the bolt positioned between the first half connector body and the second half connector body, which is compressed when fitting together the first half connector body and the second half connector body and the screw portion of the bolt passes through the nut and freely turns, and which pulls a base end of the screw portion of the bolt toward the nut by a repulsion force caused by compression of the approximately V-shaped single piece plate spring compressed between and in contact with the stopper and the other of the first half connector body and the second half connector body.

8. A bolt-tightened connector according to claim 7, wherein:

the first half connector body has a slide groove to engage with and secure the harness fixing piece and the harness fixing piece is made attachable and detachable to and from the slide groove.

9. A bolt-tightened connector according to claim 7, wherein an approximately V-shaped plate spring is provided which is arranged at an intermediate region of the bolt positioned inside of one of the first half connector body and the second half connector body, which is compressed when fitting together the first half connector body and the second half connector body and the screw portion of the bolt passes through the nut and freely turns, and which pulls a base end of the screw portion of the bolt toward the nut by the repulsion force caused by the compression.

10. A bolt-tightened connector according to claim 7, wherein:

the other of the first half connector body and the other second half connector body has a cylindrical nut holder for securing the nut, the bolt has a stopper attached in the intermediate region toward the head and a step portion formed in the intermediate region toward the screw portion, and the plate spring is attached between the stopper and the step portion and is compressed between the stopper and the front end of the nut holder when the screw portion of the bolt passes through the nut.

11. A bolt-tightened connector according to claim 7, wherein the nut is integrally secured to the other of the first half connector body and second half connector body by insert molding.

12. A bolt-tightened connector according to claim 7, wherein the nut is inserted into the cylindrical nut holder formed at the other half connector body and then is secured by inserting the cylindrical member to the nut holder to grip it.

13. A bolt-tightened connector according to claim 7, wherein the plate spring is held with respect to one of the first half connector body and second half connector body so as to restrict rotation thereof about the bolt.

* * * * *